US008371963B2

(12) United States Patent
DelGreco et al.

(10) Patent No.: US 8,371,963 B2
(45) Date of Patent: Feb. 12, 2013

(54) PIVOTING TRAINING DEVICE FOR A BASEBALL BATTER

(76) Inventors: Susan DelGreco, Millburn, NJ (US); Carol West, Maplewood, NJ (US)

( * ) Notice: Subject to any disclaimer, the term of this patent is extended or adjusted under 35 U.S.C. 154(b) by 0 days.

(21) Appl. No.: 12/931,056

(22) Filed: Jan. 24, 2011

(65) Prior Publication Data

US 2012/0190484 A1 Jul. 26, 2012

(51) Int. Cl.
*A63B 69/00* (2006.01)

(52) U.S. Cl. ..... 473/452; 473/422

(58) Field of Classification Search ..... 473/422, 473/451, 452, 497, 218, 270, 272
See application file for complete search history.

(56) References Cited

U.S. PATENT DOCUMENTS 2,189,613 A * 2/1940 Paulsen ..... 473/270
3,352,559 A * 11/1967 Larsen ..... 473/269
3,372,930 A * 3/1968 Sertich ..... 473/452
5,037,094 A * 8/1991 Johnson ..... 473/452
5,318,290 A * 6/1994 Sawyer ..... 473/217
5,810,673 A * 9/1998 Castleberry ..... 473/217
5,976,026 A * 11/1999 Erb ..... 473/272
6,102,818 A * 8/2000 Hamilton ..... 473/452
6,723,004 B1 * 4/2004 Florian ..... 473/270
6,749,529 B1 * 6/2004 Sobolewski ..... 473/451
6,945,883 B1 * 9/2005 Williams et al. ..... 473/452
7,335,117 B2 * 2/2008 Reason-Kerkhoff ..... 473/452
7,435,194 B1 * 10/2008 Lewis ..... 473/454

* cited by examiner

*Primary Examiner* — Mitra Aryanpour
(74) *Attorney, Agent, or Firm* — Stephen P. Kearney

(57) ABSTRACT

The invention is a training device for baseball batters and, more generally, is a training device for any athletic motion that utilizes a foot pivoting movement. The invention has a mat, pivot device and toe hold. The mat is approximately the size of baseball batters box. For baseball training, the mat is placed in the batters box such that the pivot device is facing the rear. The baseball player places his rear foot on the pivot device and his front foot in one of the toe holds. The baseball player trains by maintaining rear foot contact on the pivot, and pivoting his rear foot during the swing.

1 Claim, 1 Drawing Sheet

PIVOTING TRAINING DEVICE FOR A BASEBALL BATTER

BACKGROUND OF THE INVENTION

There are numerous training devices that are intended to aid in development of baseball hitting skills. Generally the prior training devices are used to support a baseball either in a fixed position or on a tether, so that a batter standing in position can practice swinging his bat to hit the ball. The prior training devices do not include any surface for the baseball batter to stand on; the baseball batter stands next to the training device on whatever surface is available. The prior training devices do not provide any direction or assistance to the baseball player regarding the player's stance, foot placement, or movement of feet and body during the swing.

Therefore, it is an objective of the present invention to provide a training device that assists the baseball player in effective stance, foot placement, and movement of feet and body during the swing.

DETAILED DESCRIPTION OF THE INVENTION

A batters box mat 1 contains a pivot device 2 which is mounted within a pivot recess 3. In a preferred embodiment the batters box mat 1 is made of a flexible material such as rubber. In a preferred embodiment, the top surface of pivot device 2 is set at an elevation equal to the top surface of batters box mat 1. In a preferred embodiment, pivot device 2 comprises a circular device with ball bearing that rotates freely about an axis perpendicular to the surface of batters box mat 1. In a preferred embodiment toe stops 4 are recessed into the top surface of batters box mat 1. In a preferred embodiment there is more than one toehold, to allow for different stances of baseball batters.

The batters box mat 1 can be used for both right had and left hand batters. During training the batters box mat 1 is placed in the batters box, to the right or left of home plate according to whether the batter is right or left handed. The batters box mat 1 is oriented such that the pivot device 2 is nearer the catcher and the toe holds 4 are nearer the pitcher. The baseball batter stands on the batters box mat 1 with his rear foot resting on the pivot device 2 and the front foot resting on a toehold 4. The baseball batter practices pivoting his rear foot on pivot device 2 while swinging the baseball bat, in order to maximize effectiveness of body rotation and bat swing.

Although the preferred embodiment includes flexible batters box mat other embodiments are possible using rigid Or semi-rigid mat material. Although the preferred embodiment includes pivot device with top surface set at al elevations equal to top of batters box mat, other embodiments are possible using pivot device elevations below or above the top of batters box mat. Although the preferred embodiment includes pivot device with ball bearing, other pivoting mechanisms such as roller bearing or lubricated slide bearing are possible. Although the preferred embodiment includes recessed holds, other embodiments are possible with raised toeholds, or no toe holds at all. Although the preferred embodiment does not include a home plate or any means of supporting a baseball in a position to be batted by batter, other embodiments are possible that would include a home plate and/or support for a baseball in position to be batted.

SUMMARY OF THE INVENTION

A training device for baseball batters with a batters box mat and rear foot pivot is provided. In a preferred embodiment, toe holds for the front foot will also be provided. The baseball batter will stand on the mat with the rear foot resting on the pivot and the front foot resting on the toehold. The baseball batter will practice pivoting his rear foot while swinging the baseball bat, in order to maximize effectiveness of the swing.

Figure 1:
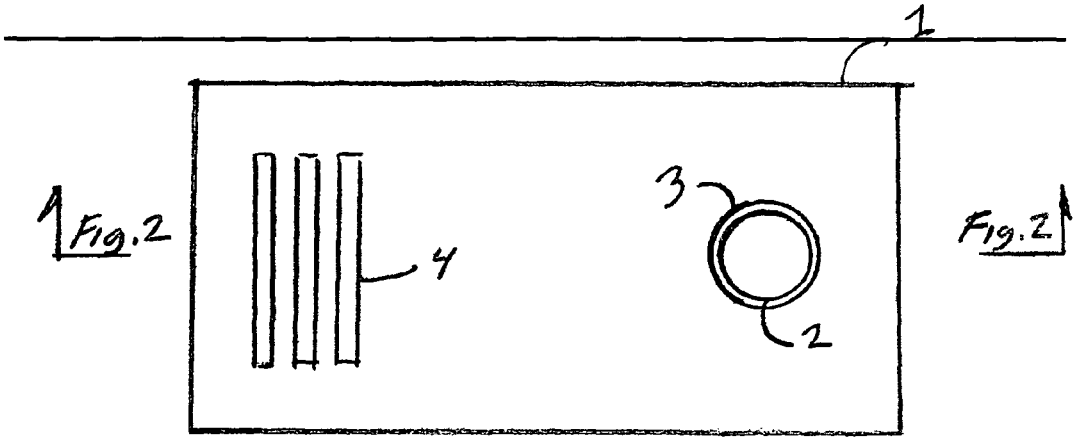
FIG. 1 is an overall plan view of a preferred embodiment of the invention, showing batters box mat 1, pivot device 2, pivot recess 3 and toe stops 4.
Figure 2:
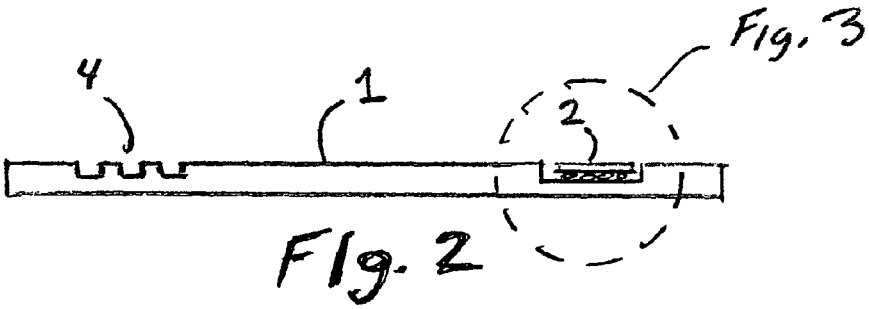
FIG. 2 is an overall sectional view of a preferred embodiment of the invention.
Figure 3:
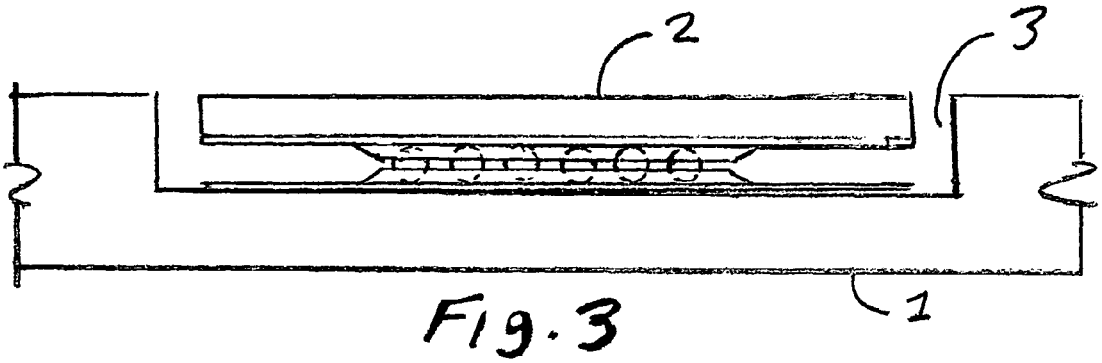
FIG. 3 is a blown up sectional view a preferred embodiment of the pivot and pivot recess.

What is claimed is:

1. A training device for baseball players comprising:

a batters-box mat defining a top planar surface, a forward edge, a rearward edge, and two lateral edges extending substantially perpendicularly from said forward edge to said rearward edge on each side of said batters-box mat; said batters-box mat having a pitcher's end located toward the forward edge, and a catcher's end located toward the rearward edge, and having a recessed pivot area, said recessed pivot area being located substantially toward the catcher's end of the batters-box mat, being substantially circular in shape, and being recessed from the top planar surface of the batters-box mat;

a pivot device comprising a top surface which is substantially level with the top planar surface of said batters-box mat, and being substantially circular in shape, being substantially complementary with said recessed pivot area, and being positioned within said recessed pivot area;

a bearing surface positioned between said pivot device and said recessed pivot area, said bearing surface being capable of reducing friction between said pivot device and said recessed pivot area such that the pivot device is capable of pivoting about an axis of rotation that is perpendicular to the top planar surface of the batters-box mat; and a forward toe-hold positioned toward the pitcher's end of said batters-box mat and comprising a plurality of grooves, said grooves being substantially linear, being substantially perpendicular to said lateral edges of said batters-box mat, and being recessed from the top planar surface of said batters-box mat.

* * * * *